US009440159B1

(12) United States Patent
Vreugdenhil et al.

(10) Patent No.: US 9,440,159 B1
(45) Date of Patent: Sep. 13, 2016

(54) RECHARGEABLE TOY VEHICLES

(71) Applicants: Johan Vreugdenhil, Pleasanton, CA (US); Paul S. Rago, Danville, CA (US); David B. Small, San Jose, CA (US)

(72) Inventors: Johan Vreugdenhil, Pleasanton, CA (US); Paul S. Rago, Danville, CA (US); David B. Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 512 days.

(21) Appl. No.: 13/725,357

(22) Filed: Dec. 21, 2012

(51) Int. Cl.
*A63H 17/00* (2006.01)
*A63H 17/26* (2006.01)

(52) U.S. Cl.
CPC ..... *A63H 17/26* (2013.01)

(58) Field of Classification Search
CPC ..... A63H 2200/00; A63H 29/22; A63H 17/262; A63H 29/24; A63H 30/04; A63H 29/00
See application file for complete search history.

(56) References Cited

U.S. PATENT DOCUMENTS

| | | | | |
|---|---|---|---|---|
| 3,891,044 | A * | 6/1975 | Tiede | 180/222 |
| 4,245,427 | A | 1/1981 | Accornero | |
| 4,329,810 | A | 5/1982 | Terui | |
| 4,438,589 | A | 3/1984 | Matsushiro | |
| 4,480,401 | A | 11/1984 | Matsushiro | |
| 4,636,178 | A * | 1/1987 | Oda | 446/462 |
| 4,649,305 | A * | 3/1987 | Morrill | 310/72 |
| 4,697,133 | A | 9/1987 | Pergandis | |
| 4,817,948 | A | 4/1989 | Simonelli | |
| 5,135,427 | A | 8/1992 | Suto et al. | |
| 5,322,469 | A | 6/1994 | Tilbor | |
| 6,062,943 | A * | 5/2000 | Maleika | 446/444 |
| 6,326,766 | B1 | 12/2001 | Small | |
| 7,100,968 | B2 * | 9/2006 | Mataja et al. | 296/177 |
| 7,694,705 | B2 * | 4/2010 | Yokobori | 152/176 |
| 2004/0063379 | A1 * | 4/2004 | Hui | 446/93 |
| 2004/0063383 | A1 * | 4/2004 | Hui | 446/454 |
| 2004/0063384 | A1 * | 4/2004 | Hui | 446/465 |
| 2005/0176345 | A1 * | 8/2005 | Harrelson et al. | 446/456 |
| 2012/0028538 | A1 * | 2/2012 | Wong | 446/457 |

* cited by examiner

*Primary Examiner* — Michael Dennis
*Assistant Examiner* — Urszula M Cegielnik
(74) *Attorney, Agent, or Firm* — Blakely Sokoloff Taylor & Zafman LLP

(57) ABSTRACT

Toy vehicles having a toy vehicle body having front and back ends, front and rear axles, each axle having first and second wheels fastened onto respective ends thereof, the wheels having elastic tires thereon, the front and rear axles being mounted to the toy vehicle body with the axles being parallel to each other, a motor within the toy vehicle body, and a source of electrical power within the toy vehicle body, the motor being disposed with an axis of its motor shaft passing through an axis of one of the axles and contacting the side of a tire on the wheel adjacent the motor shaft to drive the tire and thus both wheels on the respective axle in rotation to propel the toy vehicle, the side of the tire contacted by the motor shaft facing the second tire and wheel on the same axle.

26 Claims, 6 Drawing Sheets

RECHARGEABLE TOY VEHICLES

BACKGROUND OF THE INVENTION

1. Field of the Invention

The present invention relates to the field of electrically powered toy vehicles, particularly in the form of toy race cars.

2. Prior Art

Electrically powered toy race cars are well known in the prior art. Such race cars take various forms and sizes. Of particular importance to the present invention are prior art race cars which are sold together with track sections which can be assembled into a race track for the cars. The track, of course, must have a size that is in proportion to the race cars themselves, and accordingly, to keep costs down there is an advantage in manufacturing and selling very small cars which in turn will use relatively small tracks.

Most electrically powered race cars utilize small rechargeable batteries together with an electric motor that somehow transfers rotary power to a set of wheels. In some electric toy race car designs the motor is mounted with its shaft parallel to an axle of the race car, with the shaft contacting the top of the tire on the respective wheel of the car to provide a friction drive thereto. Such a configuration has the advantage of simplicity, though it has certain disadvantages. In particular, such an arrangement tends to pick up floor debris such as lint, particles of dust and hair which accumulate on the tire and shaft of the motor, interfering with the operation of the drive system. Another disadvantage is the fact that if a solid axle is used to couple the drive wheel of the vehicle to the opposite wheel on the same axle, the diameter of the motor can become quite limited because of the required clearance between the motor and the axle. Further, placement of the motor shaft parallel to an axle shaft means that the length of the motor determines the width of the vehicle, which in turn requires a longer vehicle to maintain the proper vehicle proportions.

DETAILED DESCRIPTION OF THE PREFERRED EMBODIMENTS

Figure 1A:
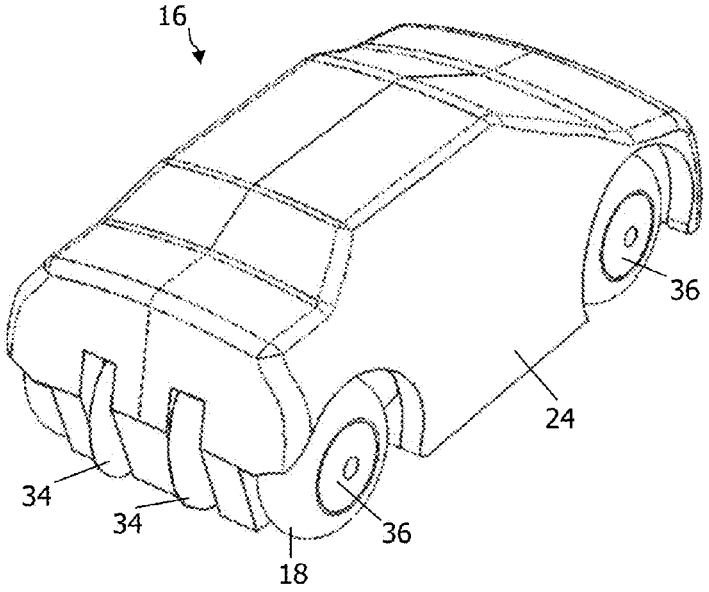
FIG. 1*a* is a rear prospective view of a toy vehicle in accordance with the present invention.
Figure 1B:
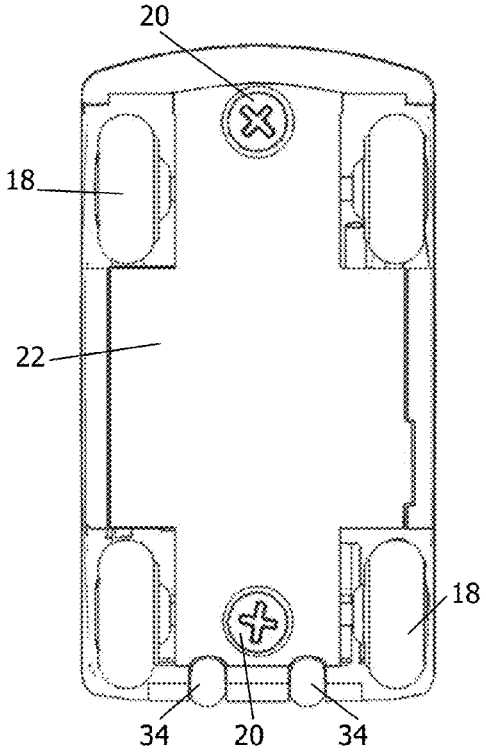
FIG. 1*b* is a bottom view of the toy vehicle of FIG. 1*a*.
Figure 1C:
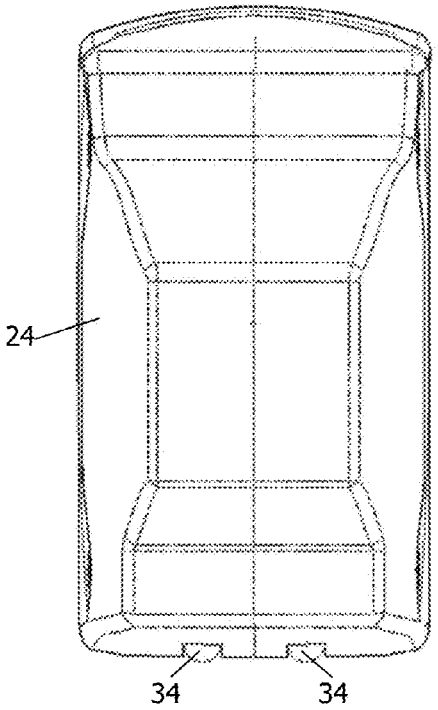
FIG. 1*c* is a top view of the toy vehicle of FIG. 1*a*.

FIGS. 1*a*, 1*b* and 1*c* are a rear prospective view, a bottom view and a top view of the toy vehicle of one embodiment of the present invention. The toy vehicle is comprised of an upper body member 24, a lower body member 22 held together with screws 20, with wheels 36 with elastic tires 18 thereon. Also visible in these Figures are contacts 34 simulating a rear bumper of the toy vehicle, and wheels 36 with elastic tires 18 thereon. The upper body member 24 extends over the edges of the lower body member 22 so that no joint or gap between the upper body member 24 and the lower body member 22 is visible from either side or the front and back of the toy vehicle.

Figure 2:
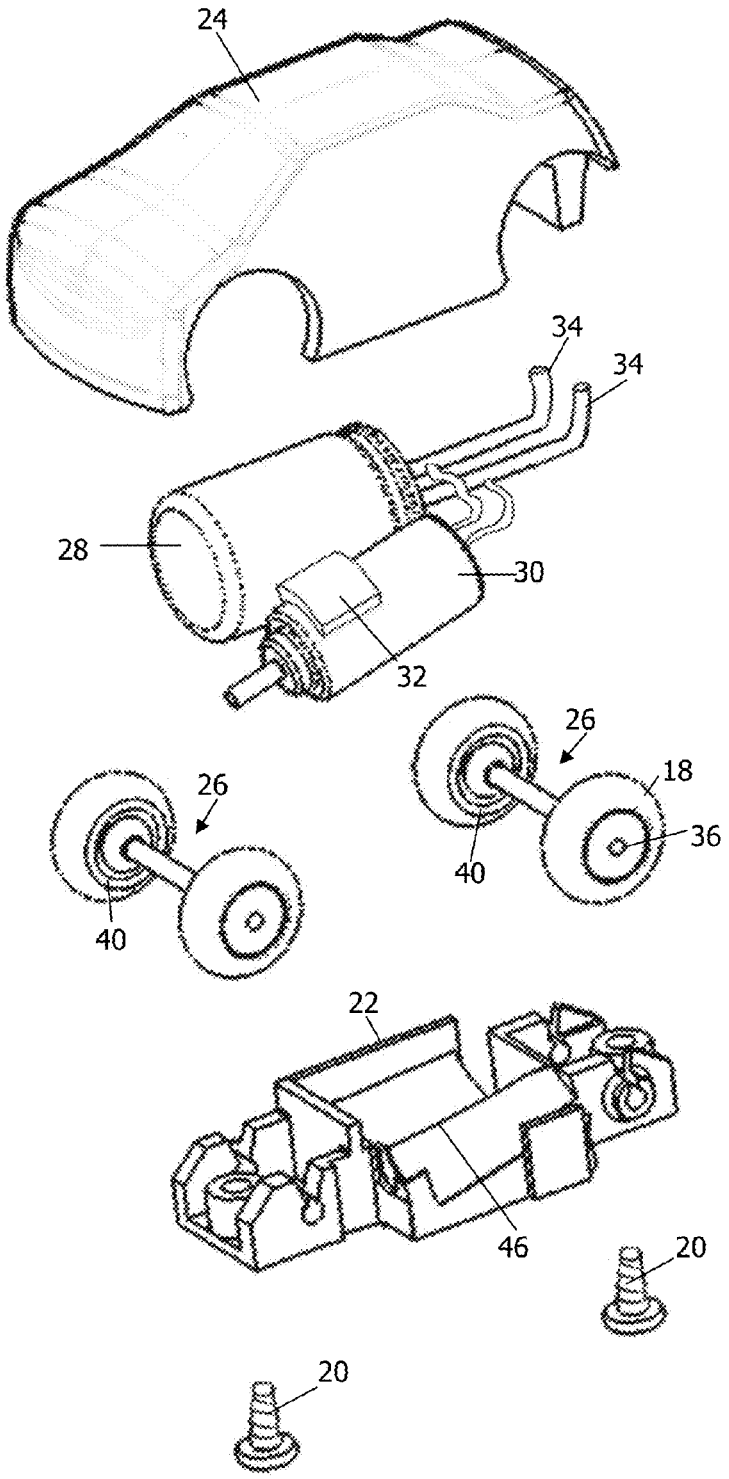
FIG. 2 presents a front perspective exploded view of the toy vehicle of FIGS. 1*a*, 1*b* and 1*c*.

FIG. 2 presents a front perspective exploded view of the toy vehicle of FIGS. 1*a*, 1*b* and 1*c*. The vehicle consists of the lower body member 22, the upper body member 24, axle assemblies 26, super capacitor 28, motor 30 with a self-adhesive foam elastic member 32 coupled to an upper portion thereof, and finally, screws 20.

A super capacitor is a capacitor that has much greater energy density and power per pound than electrostatic and electrolytic capacitors. They are now well known to those skilled in the art. Of course, one could use a rechargeable battery in the toy vehicle of the invention, though a super capacitor is preferred because of its short recharge time and its ability to be continually recharged without loss of energy retention. In one embodiment of toy vehicle in accordance with the present invention, the recharge time is only a fraction of the run time achieved on a single charge. Also super capacitors of an appropriate physical size and capacity are readily commercially available, while because of the small size of the toy vehicle of one embodiment, rechargeable batteries of an appropriate phys al size are not readily commercially available.

Figure 3A:
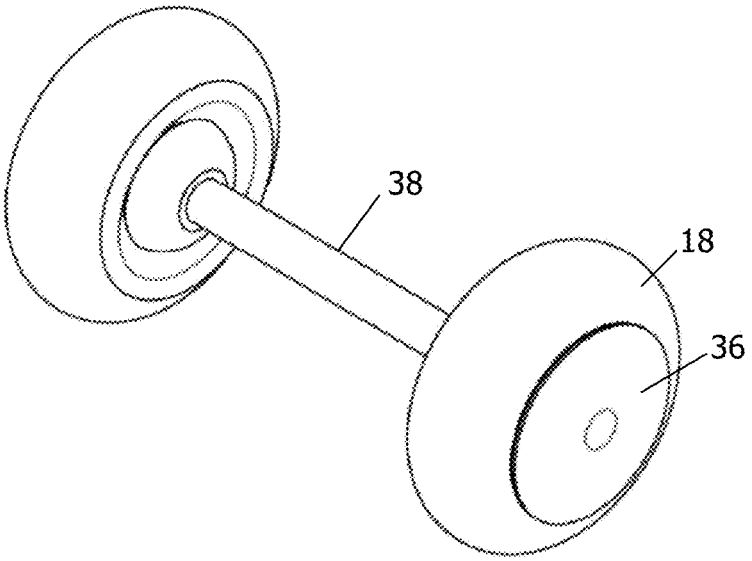
FIG. 3*a* is a perspective view of a complete axle assembly.
Figure 3B:
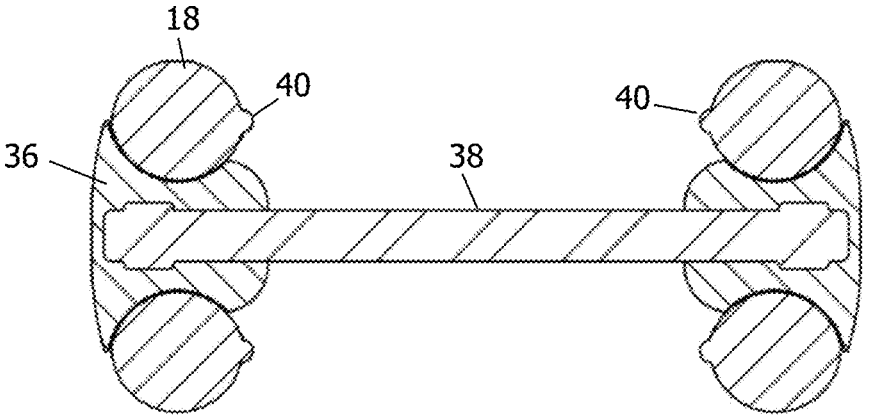
FIG. 3*b* is a cross section of the axle assembly of FIG. 3*a* taken through the centerline of the axle.

The wheels 36 and tires 18 on the axle assemblies are shown in FIGS. 3*a* and 3*b*. FIG. 3*a* is a perspective view of a complete axle assembly, with FIG. 3*b* being a cross section thereof taken through the centerline of the axle 38. As shown in FIG. 3*b*, the axle 38 is connected to a wheel 36 at each end of the axle, preferably rigidly joined to the axle in such a way as to accurately define the spacing between the wheels, such as by way of example, by pressing the axles into the wheels, molding the wheels over the axles, or sonic welding the axles into the wheels. For this purpose, the axles used in the preferred embodiment have their ends formed so as to no longer be round to aide in the gripping of the wheels. As may be seen on FIGS. 3*a* and 3*b*, the tires have an integral raised annular area 40 positioned on the inside of the tire facing the opposite wheel. As shall subsequently be seen, this forms the friction drive surface for the motor shaft. In that regard, the two axle assemblies are identical, and the tires 18 can be removed from the wheels 36. Consequently, the tires may be rotated, so to speak, like on a full size vehicle in the event the raised area on the drive wheel tire becomes worn or damaged. Alternatively screws 20 (FIG. 1*b*) can be temporarily removed and the drive axle swapped end to end and/or the axles swapped front to back and back to front to achieve the same purpose.

Figure 4:
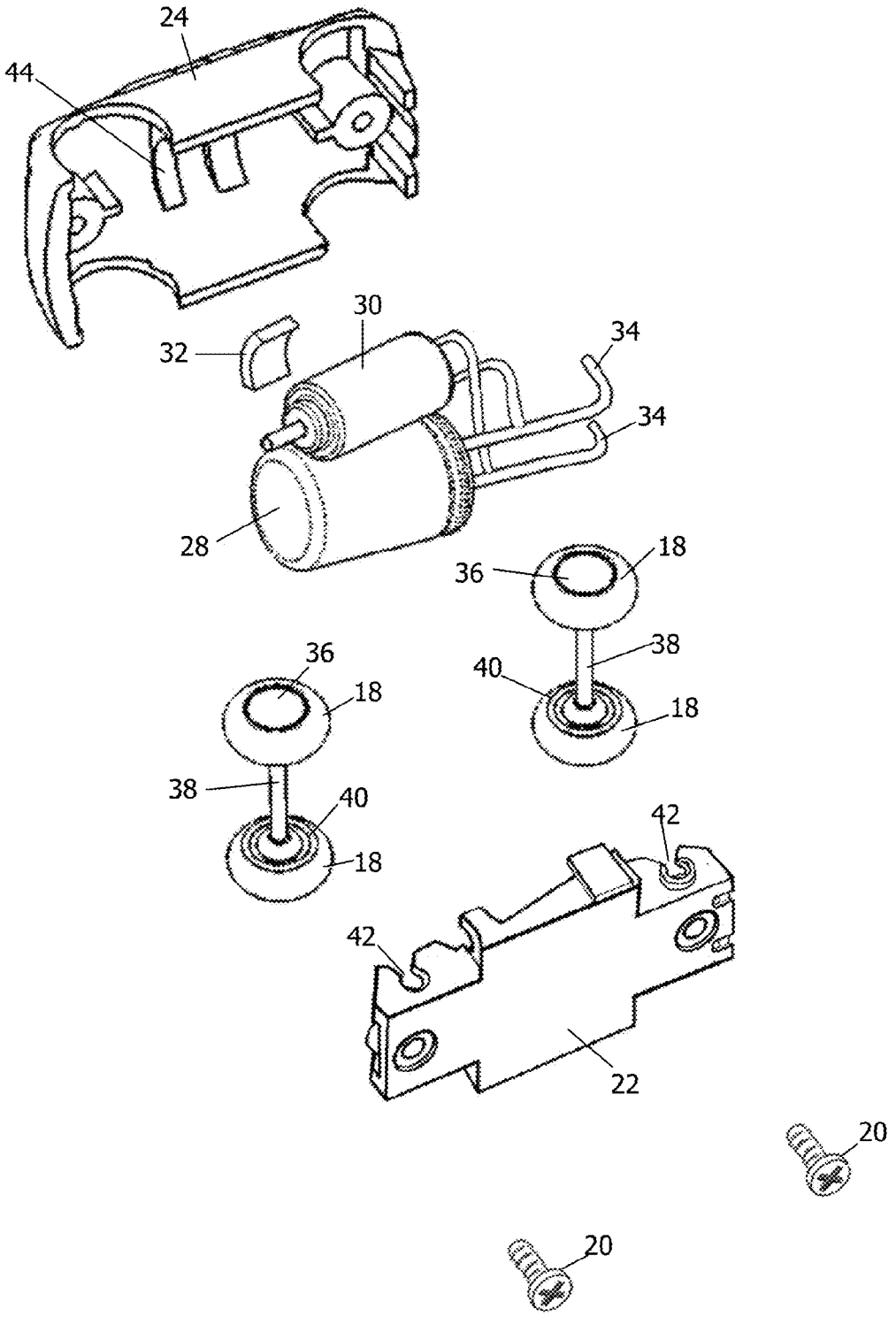
FIG. 4 is an exploded view of the entire toy vehicle.

FIG. 4 is an exploded view of the entire toy vehicle. As may be seen therein, the axles 38 snap into slots 42 in the lower body member 22. Alternatively, the axle assemblies could simply be captured between the lower body member 22 and upper body member 24, if desired. The motor 30 and super capacitor 28 are cradled between cradle projections on the upper body member 24 and the lower body member 22. The cradle projections 44 on the upper body member are visible in FIG. 4, with FIG. 2 illustrating the top of the lower body member and cradle member 46 therein. The self-adhesive foam elastic member 32 positively locates the motor with respect to the lower body member 22 for positive motor location with respect to the lower body member. Note that the leads of the motor are permanently attached (electrically connected) to the leads of the super capacitor, and the ends of the super capacitor leads are bent upward to form the contacts at the rear of the toy vehicle. In the charger used, the drive wheels are elevated by the charger body engaging the lower surface of the lower body member 22 so that the wheels can spin, thereby avoiding stalling the motor or slipping and burning of the contact between the motor shaft and the integral raised annular area 40 on the tire of the drive wheel as the super capacitor 28 is being charged.

Figure 5:
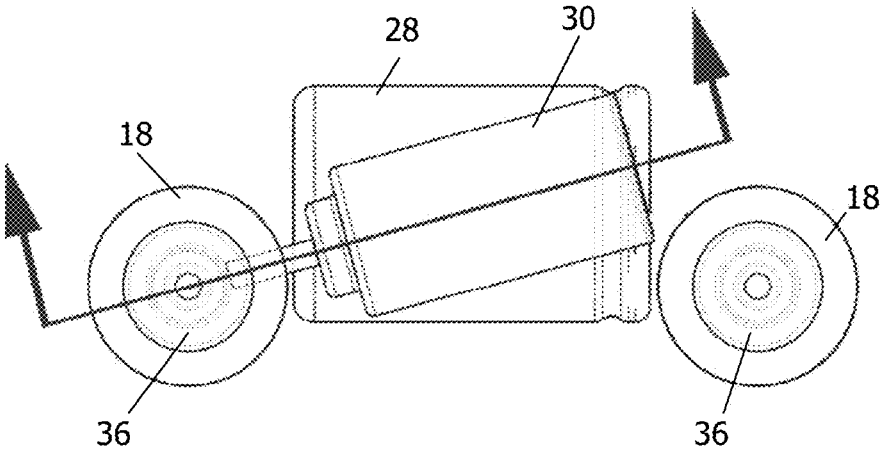
FIGS. 5 and 6 illustrate the orientation of the motor and super capacitor within the toy vehicle of one embodiment.
Figure 6:
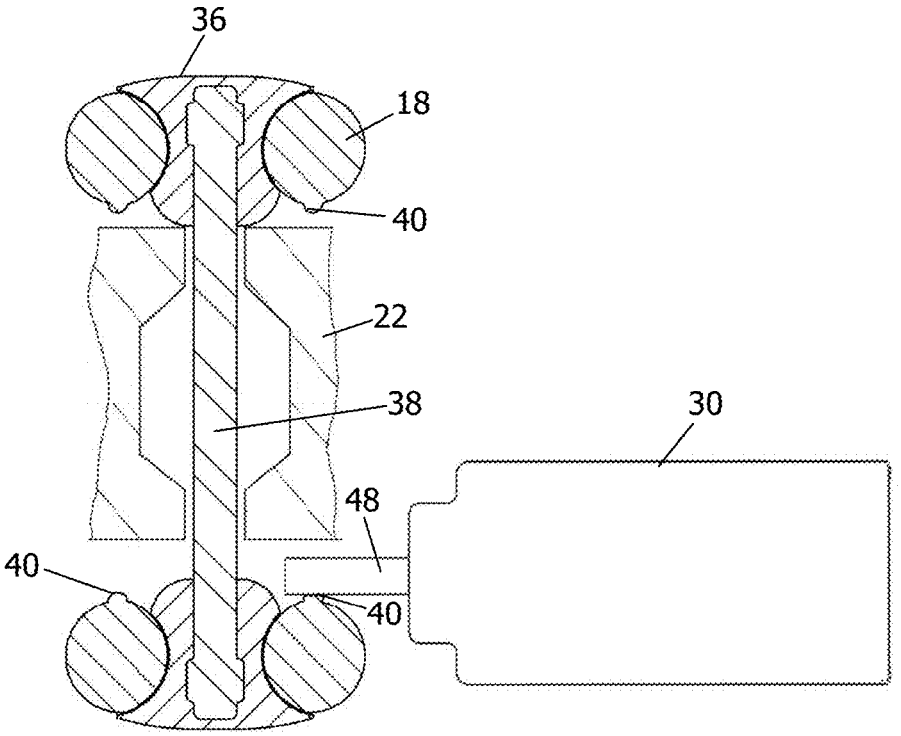
Figure 7:
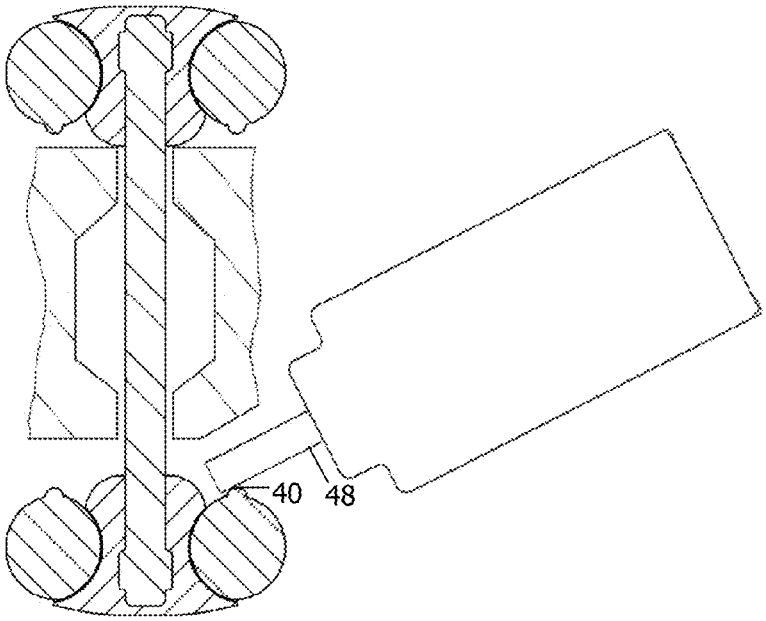
FIG. 7 illustrates an alternate orientation of the motor within the toy vehicle.

Now referring to FIGS. 5 and 6, the orientation of the motor 30 and super capacitor 28 within the toy vehicle may be seen. In one embodiment, the motor 30 is inclined somewhat to provide road clearance, so to speak. This is not required for the super capacitor 28, as the entire supper capacitor may be somewhat elevated as desired. The motor however, should preferably have the axis of the motor shaft 48 pass through the axis of the axle of the wheel being driven by the motor. In the embodiment illustrated in FIGS. 5 and 6, the motor shaft 48 axis is also perpendicular to the axis of the drive axle 38, as shown in FIG. 6. This is not required however, as the motor axis may be inclined with respect to the drive wheel axis as illustrated in FIG. 7, particularly if the motor diameter would otherwise cause a bulge in the toy vehicle body. In any event, the force between the integral raised annular area 40 on the drive wheel and the motor shaft 48 moves the respective axle 38 as far one way as possible, the axle assembly being retained from further motion along its axis by the opposite wheel 36 rubbing against the lower body member 22. For this reason, it is preferred that the smallest diameter of the wheel be the part of the wheel rubbing against the lower body member 22. With this arrangement, it has been found that the friction of the drive system is not excessive, and that the motor alignment is set sufficiently accurately by design and without adjustment to achieve quite impressive performance on a single super capacitor charge.

Figure 8:
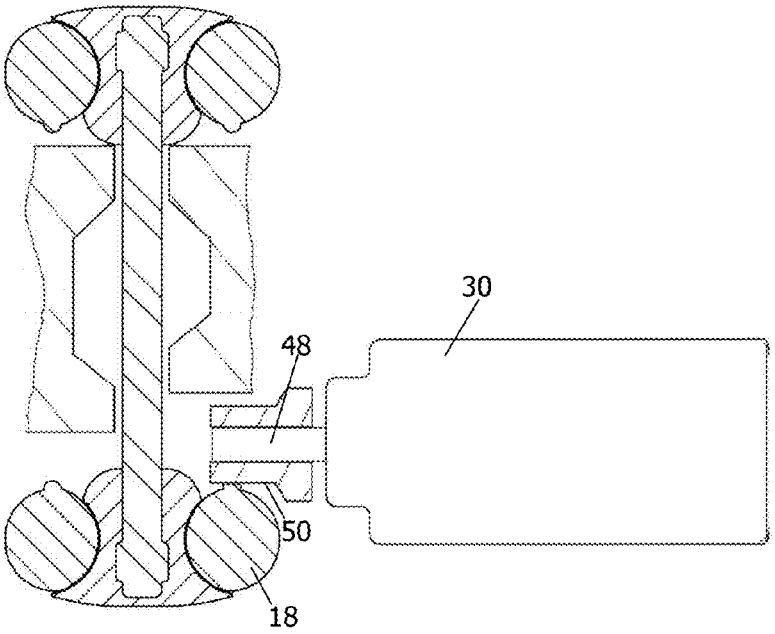
FIG. 8 illustrates an alternate drive for the motor within the toy vehicle.

A still further alternate embodiment for the motor drive is illustrated in FIG. 8. In this Figure, the shaft 48 of motor 30 has a sleeve 50 there over. The sleeve increases the effective diameter of the motor shaft and thus the speed of the toy vehicle. Also such a sleeve can be made of a plastic material having much higher friction with the tire, which in some instances could allow reduction in the contact force of the sleeve with the tire. Finally, such a sleeve also positions the motor more toward the fore and aft centerline of the toy vehicle, which could be advantageous if the motor diameter extended too far to the side of the vehicle.

An embodiment of the toy vehicle of the present invention is only approximately one inch long, and has the proportions of a real vehicle. The front wheel drive improves the stability of the toy vehicle, and packages easier, in that the inclination of the motor to provide bottom clearance increases the toy vehicle height toward the rear of the toy vehicle as in many full size vehicle designs. Also, placing the axis of the motor shaft lengthwise in the toy vehicle rather than crosswise saves vehicle width for the same motor size, and thus results in a smaller toy vehicle of appropriate toy vehicle length to width proportions for a given motor size. In one embodiment, the toy vehicles are in the form of race cars, and can be manufactured not only with different color schemes and decorations, but also with different body styles, as the body styles are determined exclusively by the upper body member 24.

Thus the present invention has a number of aspects, which aspects may be practiced alone or in various combinations or sub-combinations, as desired. While a preferred embodiment of the present invention has been disclosed and described herein for purposes of illustration and not for purposes of limitation, it will be understood by those skilled in the art that various changes in form and detail may be made therein without departing from the spirit and scope of the invention as defined by the full breadth of the following claims.

What is claimed is:

1. A toy vehicle comprising:

a toy vehicle body having front and back ends;

four elastic tires, at least one elastic tire having a raised annular area on a side of the tire, the raised area having a diameter that is less than an outer diameter of the tire;

four wheels, each wheel having an elastic tire thereon;

front and rear axles, each axle having first and second wheels fastened onto respective ends thereof, the raised annular area on the side of the tire being arranged to face the opposite wheel;

the front and rear axles being mounted to the toy vehicle body with the axles being parallel to each other; and a motor within the toy vehicle body, the motor including a motor shaft that contacts the raised annular area on the side of one tire to drive the tire by frictional forces on the side of the tire.

2. The toy vehicle of claim 1 wherein the axis of the motor shaft is perpendicular to the respective axle.

3. The toy vehicle of claim 2 wherein the motor is disposed with an axis of its motor shaft passing through an axis of the front axle and contacting the first side of the tire contacted by the motor shaft to drive the tire by frictional forces on the first side of the tire and thus both front wheels on the front axle in rotation to propel the toy vehicle.

4. The toy vehicle of claim 1 wherein all four tires are the same.

5. The toy vehicle of claim 4 wherein the front and rear axle assemblies are the same, each axle assembly comprising the axle, pair of wheels and tires being removable as an assembly from and re-mountable as an assembly on the toy vehicle body, whereby the raised area of the tire frictionally contacted by the motor shaft may be replaced with another of the four tires by swapping the drive axle end for end, and/or by swapping the front and rear axles.

6. The toy vehicle of claim 4 wherein the tires are removable from and re-mountable on the wheels, whereby the raised area of the tire frictionally contacted by the motor shaft may be replaced with another of the four tires.

7. The toy vehicle of claim 6 wherein the body of the toy vehicle comprises an upper body member and a lower body member that are fastened together.

8. The toy vehicle of claim 7 wherein the upper body member and the lower body member, when fastened together, retain a super capacitor as the source of electrical power within the toy vehicle body and the motor.

9. The toy vehicle of claim 8 wherein the upper body member extends over the lower body member whereby there is no joint or gap visible when viewing the toy vehicle from either side or either end of the toy vehicle.

10. The toy vehicle of claim 8 wherein an elastic member is disposed between the motor and the body.

11. The toy vehicle of claim 10 wherein the elastic member is positioned in the body to cause the upper body member to push the motor against the lower body member, whereby the lower body member determines the position and alignment of the motor relative to the side of the tire the motor shaft frictionally contacts.

12. The toy vehicle of claim 1 wherein the source of electrical power within the toy vehicle body is a super capacitor.

13. The toy vehicle of claim 12 wherein the super capacitor and the motor are wired together without a switch between the super capacitor and the motor.

14. The toy vehicle of claim 13 wherein ends of the leads of the super capacitor are bent to form contacts at a back of the toy vehicle for contact by a charger.

15. A toy vehicle comprising:

a toy vehicle body having a front and a back;

four elastic tires, at least one elastic tire having a raised annular area on a side of the tire, the raised area having a diameter that is less than an outer diameter of the tire;

four wheels, each wheel having an elastic tire thereon;

front and rear axles, each axle having first and second wheels fastened onto respective ends thereof, the raised annular area on the side of the tire being arranged to face the opposite wheel;

the front and rear axles being mounted to the toy vehicle body with the axles being parallel to each other; and a motor within the toy vehicle body, the motor including a motor shaft that contacts the raised annular area on the side of one tire to drive the tire by frictional forces on the side of the tire; and a super capacitor within the toy vehicle body and permanently electrically connected to the motor.

16. The toy vehicle of claim 15 wherein all four tires are the same.

17. The toy vehicle of claim 16 wherein the front and rear axles, wheels and tires comprising an axle assembly are the same, the axle assemblies being removable from and re-mountable on the toy vehicle body, whereby the tire frictionally contacted by the motor shaft may be replaced with another of the four tires by swapping the drive axle end for end, and/or by swapping the front and rear axles.

18. The toy vehicle of claim 16 wherein the tires are removable from and re-mountable on the wheels, whereby the tire frictionally contacted by the motor shaft may be replaced with another of the four tires.

19. The toy vehicle of claim 18 wherein the body of the toy vehicle comprises an upper body member and a lower body member that are fastened together.

20. The toy vehicle of claim 19 wherein the upper body member and the lower body member, when fastened together, retain the super capacitor and the motor.

21. The toy vehicle of claim 20 wherein the upper body member extends over the edges of the lower body member whereby there is no joint or gap visible when viewing the toy vehicle from either side or either end of the toy vehicle.

22. The toy vehicle of claim 2 wherein an elastic member is disposed between the motor and the body.

23. The toy vehicle of claim 22 wherein the elastic member is positioned in the body to push the motor against the lower body member, whereby the lower body member determines the position and alignment of the motor relative to the side of the tire the motor shaft frictionally contacts.

24. The toy vehicle of claim 15 wherein ends of the leads of the super capacitor are bent to form contacts at a back of the toy vehicle for contact by a charger.

25. The toy vehicle of claim 15 wherein the front and rear axles pass through the toy vehicle body and the axle having the wheel with the driven tire is retained from further motion along its axis by the opposite wheel rubbing against the toy vehicle body.

26. The toy vehicle of claim 1 wherein the front and rear axles pass through the toy vehicle body and the axle having the wheel with the driven tire is retained from further motion along its axis by the opposite wheel rubbing against the toy vehicle body.

* * * * *